US006097289A

United States Patent [19]

Li et al.

[11] Patent Number: 6,097,289

[45] Date of Patent: Aug. 1, 2000

[54] INTELLIGENT SPEAKER CONTROLLER FOR A FIRE ALARM SYSTEM

[75] Inventors: Richard Qi Li; Bradley Charles Detlor, both of Toronto, Canada

[73] Assignee: Forward Safety Systems Inc., Ontario, Canada

[21] Appl. No.: 08/982,125

[22] Filed: Dec. 1, 1997

[51] Int. Cl.[7] ..... G08B 1/00

[52] U.S. Cl. ..... 340/531; 340/692; 340/628; 340/326; 340/506

[58] Field of Search ..... 340/506, 531, 340/825.06, 692, 691, 693, 628, 629, 630, 584, 326

[56] References Cited

U.S. PATENT DOCUMENTS 5,654,690 8/1997 Ishikawa et al. ..... 340/506

5,663,714 9/1997 Fray ..... 340/692

*Primary Examiner*—Daryl Pope

*Attorney, Agent, or Firm*—Connolly Bove Lodge & Hutz LLP

[57] ABSTRACT

A speaker controller for a fire alarm system including a control panel and at least one speaker to broadcast tone and/or voice signals during a fire alarm condition acts between the control panel and the at least one speaker. The speaker controller includes a signal recognizer to monitor tone and/or voice signals conveyed to the speaker. Manually actuable switching means are provided to disable the speaker. A reset circuit is responsive to the signal recognizer and resets the switching means thereby to enable the speaker upon a predetermined signal condition being detected by the signal recognizer.

22 Claims, 7 Drawing Sheets

INTELLIGENT SPEAKER CONTROLLER FOR A FIRE ALARM SYSTEM

FIELD OF THE INVENTION

The present invention relates in general to fire alarm control systems and more specifically to a speaker controller which automatically responds to at least one predetermined condition to change the operational state of a speaker.

BACKGROUND OF THE INVENTION

In prior art fire alarm systems, speakers are used to broadcast fire alarm signals to signify a fire alarm condition. The fire alarm signals may be in the form of patterned tones and/or human voices. One of the main problems associated with fire alarm systems is that false alarms frequently occur. Unfortunately, false alarms have become more than simple annoyances and have now begun to endanger the lives of individuals. In some cases, due to the numerous occurrences of false alarms, occupants have simply begun to ignore the fire alarm signals. In other more serious cases, occupants have tampered with the speakers in their dwellings to disable them. Unfortunately this has resulted in speakers of the fire alarm system located in other dwellings also to become disabled.

To deal with the above problem, significant effort has been expended to improve the design of fire alarm systems to reduce the occurrences of false alarms. Little effort has however been expended to improve the design of fire alarm systems to deal with false alarms once they have occurred. This is at least partially due to the fact that retrofitting existing fire alarm systems is difficult and expensive and great care must be taken so as not to effect adversely control panels of the fire alarm systems.

It is therefore an object of the present invention to provide a novel speaker controller for a fire alarm system and a fire alarm system incorporating the same.

SUMMARY OF THE INVENTION

According to one aspect of the present invention there is provided a speaker controller for use in a broadcasting system including a speaker receiving tone and/or voice signals, said controller comprising:

- a signal recognizer to monitor the signals conveyed to said speaker;
- switching means to disable said speaker; and
- reset means responsive to said signal recognizer, said reset means resetting said switching means thereby to enable said speaker upon a predetermined signal condition being detected by said signal recognizer.

Preferably, the speaker controller further comprising a delay timer to generate a reset signal after a predetermined amount of time has elapsed after the switching means has been actuated to disable the speaker. The reset means receives the reset signal and resets the switching means in response thereto thereby to enable the speaker.

In a preferred embodiment, the reset means is responsive to voice signals detected by the signal recognizer to reset the switching means and enable the speaker. The signal recognizer, in this embodiment, is in the form of a tone and voice signal recognition circuit which differentiates between tone and voice signals being conveyed to the speaker and provides output to the reset means upon detection of voice signals. It is also preferred that the reset means actuates the switching means to enable the speaker when input signals being conveyed to the speaker drop below a predetermined value for a predetermined amount of time Preferably, the speaker controller further includes a pair of energy reserve circuits which use the tone and voice signals applied to the speaker to charge energy stores. One of the energy reserve circuits powers the switching means and the other of the energy reserve circuits powers the tone and voice recognition circuit and the reset means.

It is also preferred that the switching means includes a relay actuated switch connected to an input to the speaker that is actuable between open and closed conditions to disable and enable the speaker. A pair of relay coils is energizeable to actuate the relay actuated switch between the open and closed conditions.

According to another aspect of the present invention there is provided a speaker controller for a fire alarm system including a control panel and at least one speaker to broadcast tone and/or voice signals during a fire alarm condition, said speaker controller acting between said control panel and said at least one speaker and comprising:

- a signal recognizer to monitor tone and/or voice signals conveyed to said speaker;
- manually actuable switching means to disable said speaker; and
- a reset circuit responsive to said signal recognizer, said reset circuit resetting said switching means thereby to enable said speaker upon a predetermined signal condition being detected by said signal recognizer.

According to still yet another aspect of the present invention there is provided a fire alarm system comprising:

- a control panel;
- a plurality of speakers connected to said control panel, said speakers receiving tone and/or voice signals in response to a fire alarm condition detected by said control panel and broadcasting said tone and/or voice signals to signify said fire alarm condition; and
- at least one speaker controller associated with one of said speakers, said speaker controller being responsive to user input to disable said one speaker and being responsive to a predetermined signal condition conveyed to said one speaker to enable said speaker.

In still yet another aspect of the present invention there is provided a method of controlling the operation of a speaker in a fire alarm system, said speaker broadcasting tone and/or voice signals in a fire alarm condition, said method comprising the steps of:

- disconnecting said speaker from said fire alarm control system during a fire alarm condition in response to a manually actuated switch;
- monitoring the signals being conveyed to said speaker while said speaker is disabled; and
- automatically reconnecting the speaker to said fire alarm control system when a predetermined signal condition being conveyed to said speaker occurs.

The present invention provides advantages in that the speaker can be disconnected from the speaker loop but is automatically reconnected to the speaker loop when any one of a number of conditions occur to ensure the speaker is ready to broadcast new fire alarm signals or voice signals. Also, since the speaker controller is powered by AC signals on the lines to the speaker, the speaker draws insufficient current to place the fire alarm control panel in a "trouble" state and therefore complies with fire alarm system supervisory requirements.

BRIEF DESCRIPTION OF THE DRAWINGS

Embodiments of the present invention will now be described more fully with reference to the accompanying drawings, in which.

DETAILED DESCRIPTION OF THE PREFERRED EMBODIMENT

Figure 1:
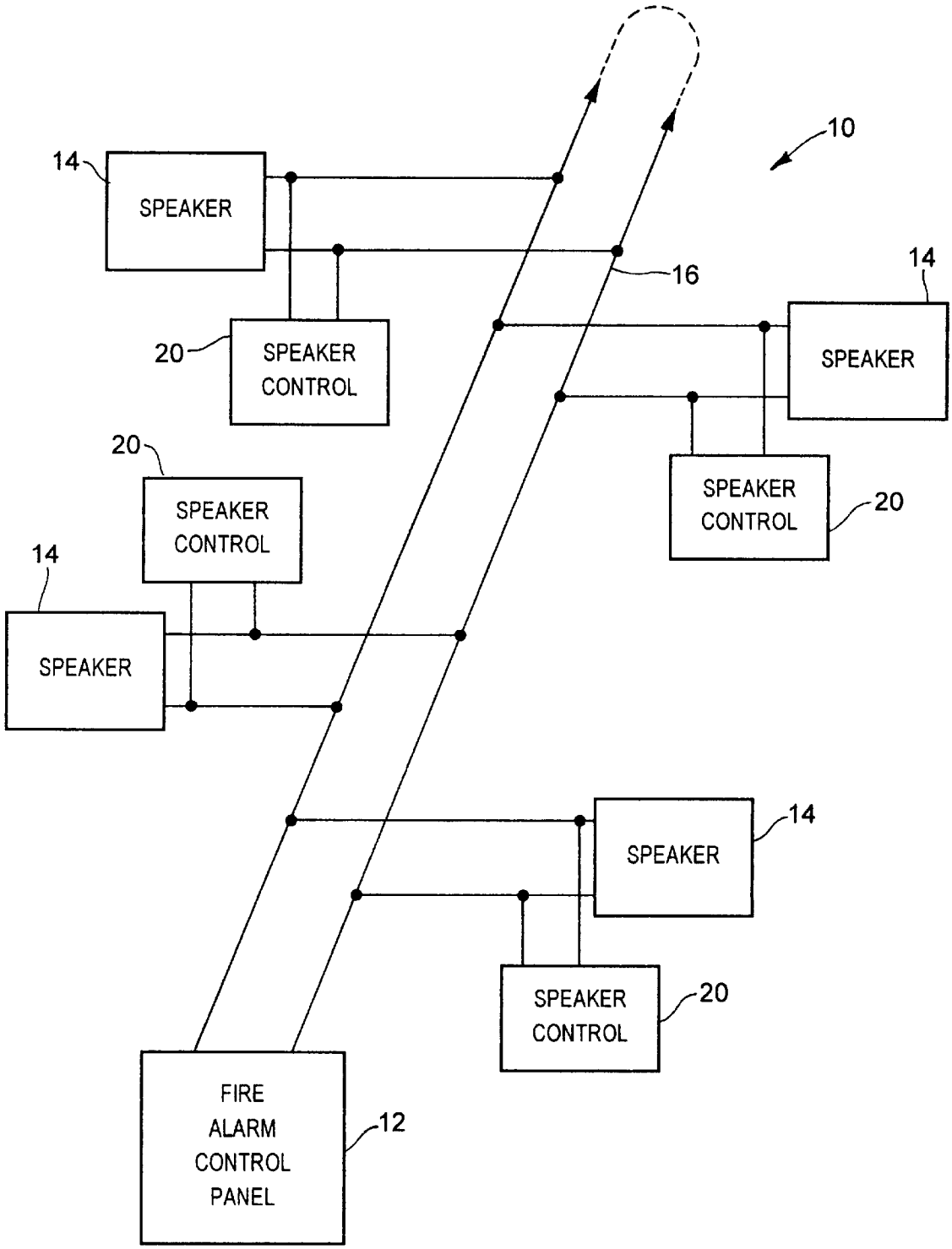
FIG. 1 is a schematic illustration of a fire alarm system.

Referring now to FIG. 1, an audible fire alarm system is shown and is generally indicated to by reference numeral 10. As can be seen, fire alarm system 10 includes a fire alarm control panel 12 and a plurality of speakers 14 connected to the control panel 12 by way of a plurality speaker loops 16 only one of which is shown. Associated with each speaker 14 is a speaker controller 20 in accordance with the present invention. As is well known, in the event of a fire alarm condition, the control panel 12 outputs patterned tones and/or voice signals which are in turn conveyed to and broadcast by the speakers 14 to provide an audible indication to occupants that a fire alarm condition exists. The speaker controllers 20 allow occupants to disable the speakers 14 but automatically reset the speakers 14 to an on condition after any one of a number of conditions occur. Further details of the speaker controllers 20 will now be more fully described with particular reference to FIGS. 2 to 5.

Figure 2:
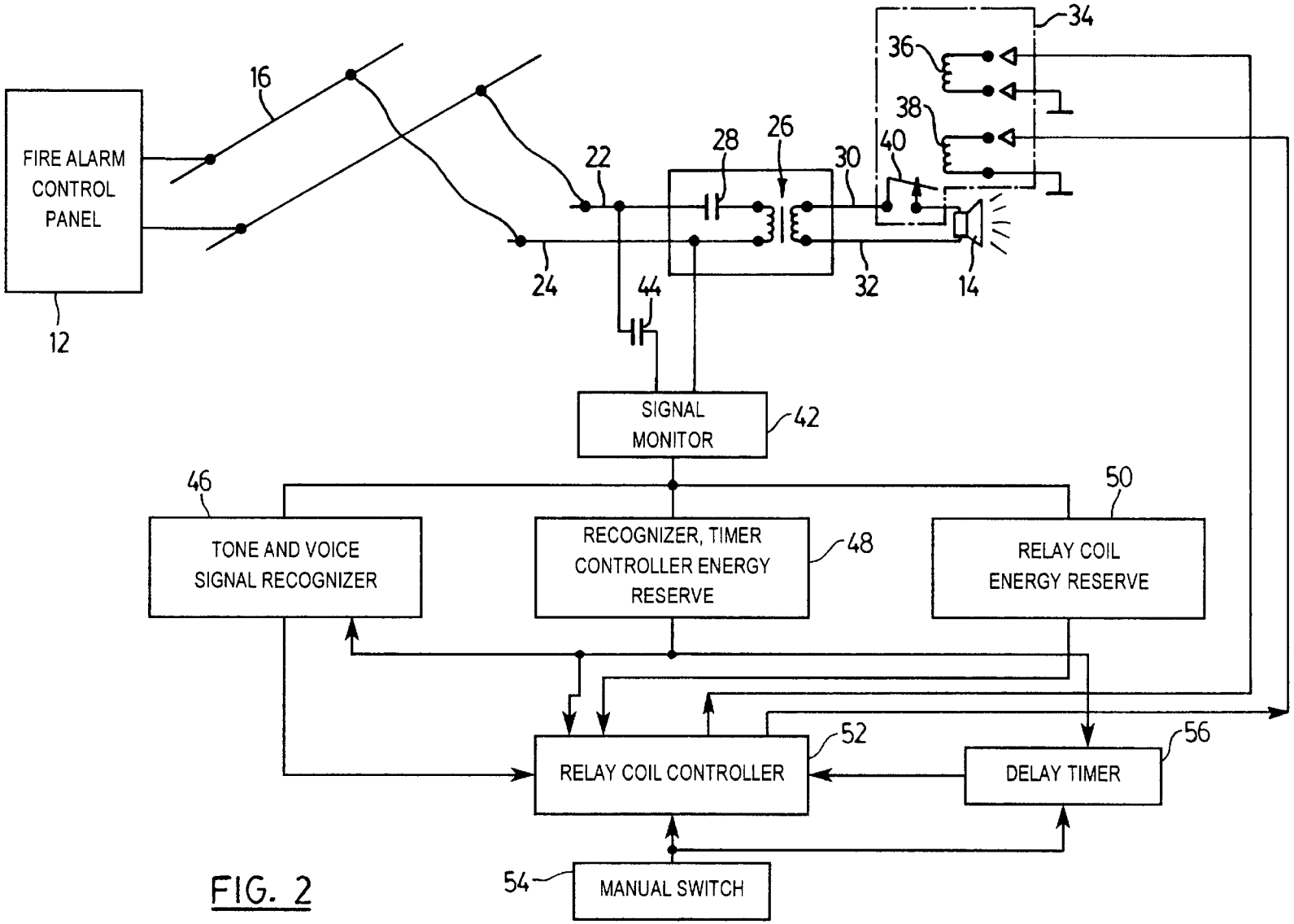
FIG. 2 is a schematic illustration in block form of a portion of the fire alarm system of FIG. 1 showing components of a speaker controller in accordance with the present invention.

Referring now to FIG. 2, one of the speakers 14 and one of the speaker controllers 20 are better illustrated. As can be seen, a pair of lines 22 and 24 extend from the speaker loop 16 and lead to the terminals of the primary winding of a transformer 26. A capacitor 28 is disposed along line 22. The secondary winding of the transformer 26 is connected to the speaker 14 by way of a pair of lines 30 and 32.

The speaker controller 20 includes a dual-coil latch relay 34 having a set coil 36, a reset coil 38 and a relay actuated switch 40. Relay actuated switch 40 is disposed along line 30 and is responsive to the set and reset coils 36 and 38 to move between open and closed conditions to disconnect and connect the speaker 14 to and from the speaker loop 16 and hence, the fire alarm control panel 12. The speaker controller 20 also includes a signal monitor 42 connected to line 22 by way of a capacitor 44 and connected directly to line 24 to monitor the signals appearing on the lines 22 and 24. The signal monitor 42 is connected to a tone and voice signal recognizer 46, a recognizer, timer, controller energy reserve 48 and a relay coil energy reserve 50. The tone and voice signal recognizer 46 receives signal input from the signal monitor 42 as well as power from the energy reserve 48 and provides output to a relay coil controller 52. The relay coil controller 52 also receives signal input from the tone and voice signal recognizer 46, power from the energy reserves 48 and 50 as well as input from a manual switch 54 and a delay timer 56. The relay coil controller 52 provides output to the set and reset coils 36 and 38. Delay timer 56 receives input from the manual switch 54 as well as power from the energy reserve 48.

Figure 3:
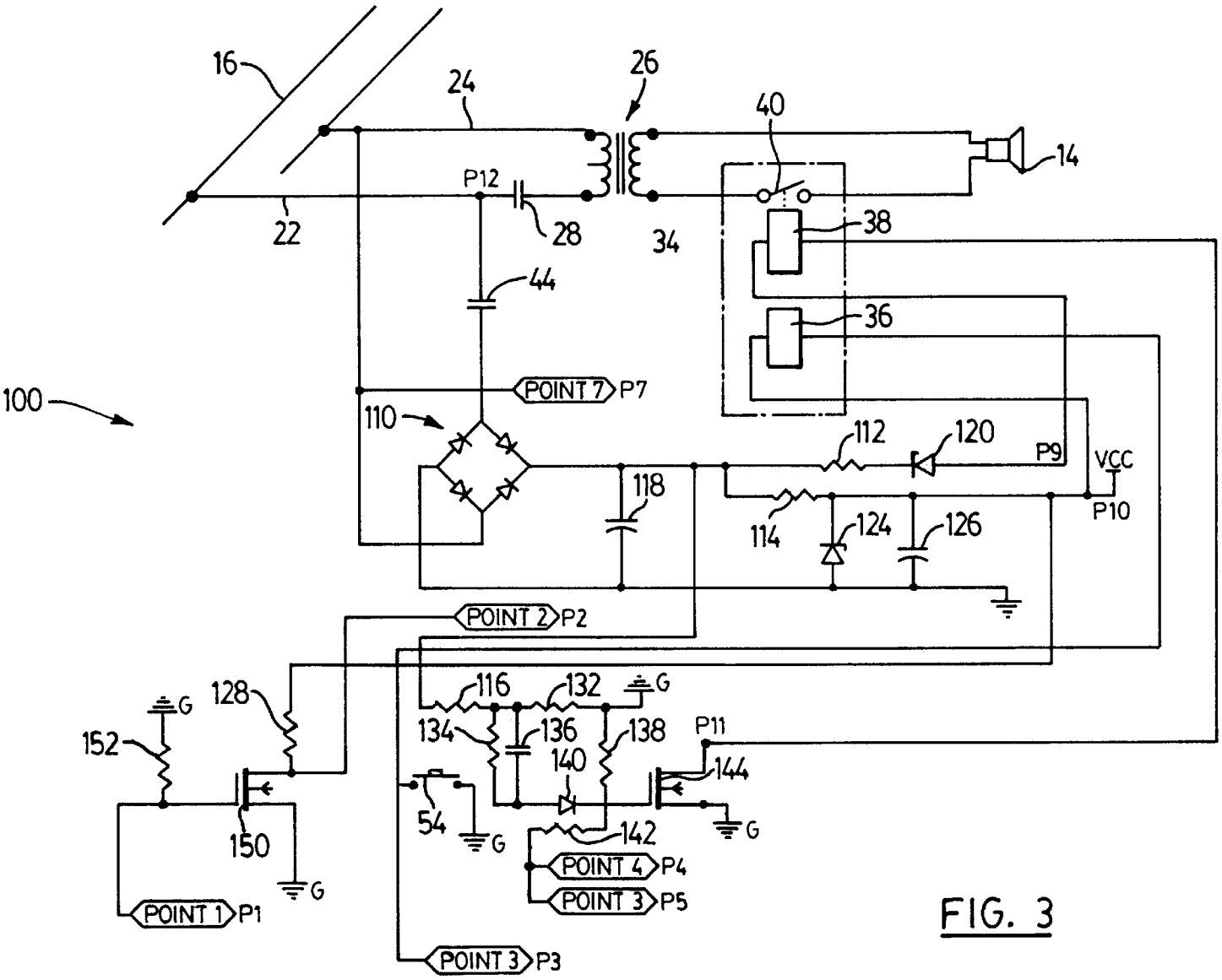
FIG. 3 is a circuit diagram of signal monitor, control circuit and relay coil energy reserves and relay coil controller circuitry forming part of the speaker controller of FIG. 2.

Referring now to FIG. 3, circuitry 100 constituting the signal monitor 42, the energy reserves 48 and 50, the relay coil controller 52 and the manual switch 54 is illustrated. As can be seen, the circuitry 100 includes a full wave rectifier 110 in the form of a diode bridge. One output node of rectifier 110 is connected to signal ground G. The other output node of rectifier 110 is connected to the terminals of three resistors 112, 114 and 116 in parallel and to one terminal of a capacitor 118. The other terminal of capacitor 118 is connected to signal ground G. The other terminal of resistor 112 is connected to the cathode of a zener diode 120. The anode of zener diode 120 is connected to one terminal of the reset coil 38 of latch relay 34. Capacitor 118 acts as an energy store for the reset coil 38.

The other terminal of resistor 114 is connected to the cathode of a zener diode 124, to one terminal of a capacitor 126 in parallel with zener diode 124, to one terminal of a resistor 128, to one terminal of the set coil 36 of latch relay 34 as well as to a positive voltage node VCC. The anode of zener diode 124 and other terminal of capacitor 126 are connected to signal ground G. Capacitor 126 acts as an energy store for the set coil 36 and as a source for voltage node VCC.

The other terminal of resistor 116 is connected to terminals of resistors 132 and 134 and capacitor 136. The resistor 132 is also connected to one terminal of a resistor 138 as well as to signal ground G. The resistor 134 and capacitor 136 are also connected to the anode of a diode 140. The cathode of diode 140 is connected to the resistor 138, to one terminal of a resistor 142 as well as to the gate of a MOSFET 144. The source of MOSFET 144 is coupled to signal ground G while the drain of MOSFET 144 is coupled to the other terminal of the reset coil 38. The other terminal of resistor 142 is connected to the delay timer 56 via node P4 and to the tone and voice signal recognizer 46 via node P5. The circuit constituted by resistors 116, 132, 134 and 138, capacitor 136 and diode 140 acts as a signal pulse generator providing a logic high on the gate of MOSFET 144 while capacitor 118 charges. Capacitor 118 charges when the speaker controller is turned on and power is supplied to the circuitry 100. The signal pulse generator provides the logic high to the gate of MOSFET for a predetermined duration determined by the charging time of capacitor 136.

The other terminal of resistor 128 is coupled to the drain of a MOSFET 150 which is also connected to node P2. The source of MOSFET 150 is coupled to signal ground G while the gate of MOSFET 150 is connected to the delay timer 56 via node P1 and to one terminal of a resistor 152. The other terminal of resistor 152 is connected to signal ground G.

The other terminal of set coil 36 is connected to the delay timer 56 by way of node P3 as well as to one terminal of the manual switch 54. The manual switch 54 has its other terminal connected to signal ground G.

Figure 4:
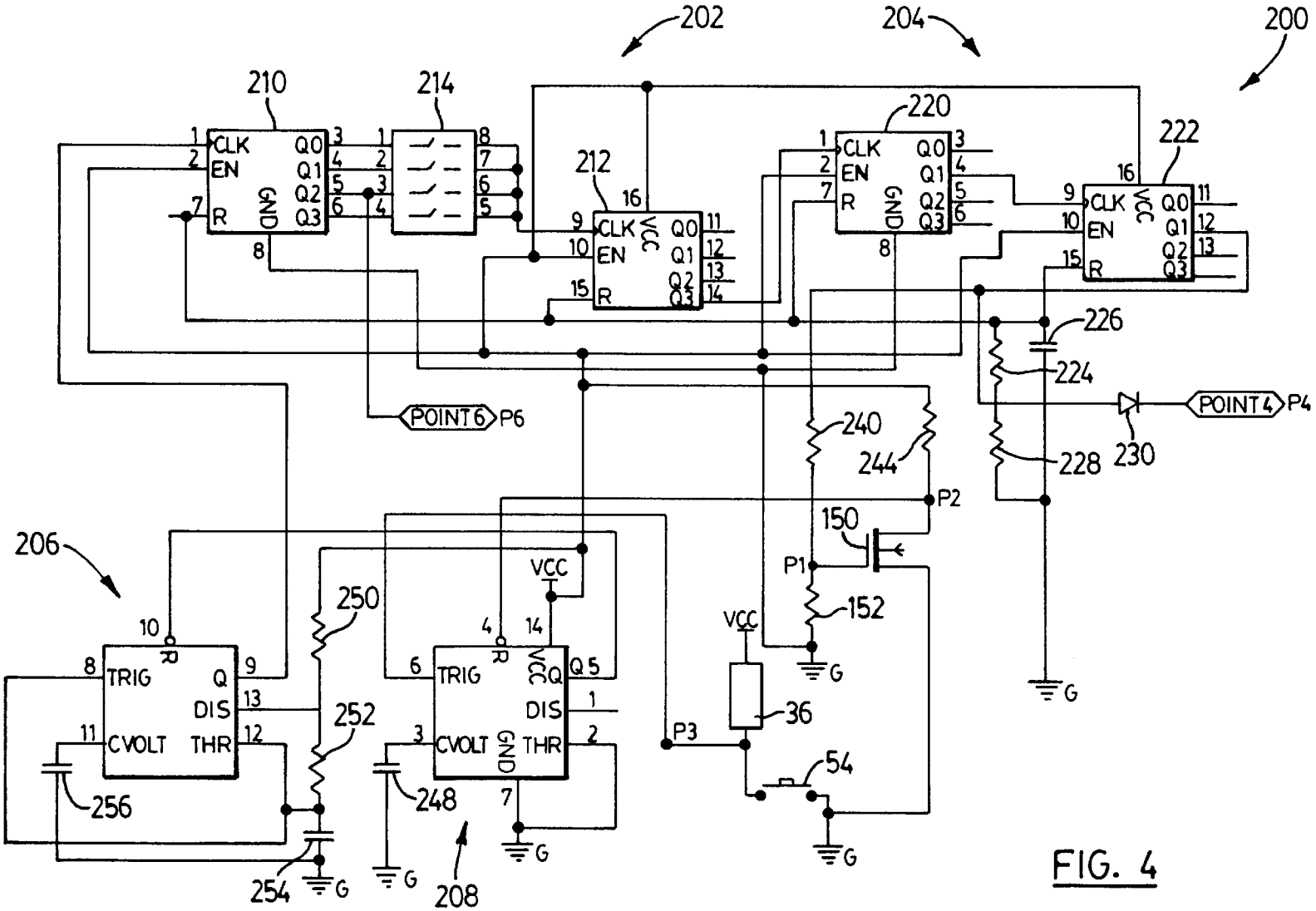
FIG. 4 is a circuit diagram of a delay timer forming part of the speaker controller of FIG. 2.

Referring now to FIG. 4, the circuitry 200 constituting the delay timer 56 is illustrated. As can be seen, circuitry 200 includes a pair of counting units 202 and 204 respectively, a time signal unit in the form of a time signal generator 206 and a start and stop unit in the form of a flip-flop capable of keeping an operational state 208. The time signal generator 206 generates output pulses at a preset frequency when enabled by the start and stop unit 208. The counting units 202 and 204 collectively count the output pulses of the time signal generator 206 and generate output signifying the expiration of the delay timer 56 after a predetermined duration has elapsed. The output of the delay timer 56 resets the latch relay 34 to close the relay actuated switch 40 and reconnect the speaker 14 to the speaker loop 16.

Counting unit 202 includes a pair of counters 210 and 212. The Q0 to Q3 output pins of the counter 210 lead to the input pins of a DIP switch 214. The output pins of the DIP switch 214 are coupled and lead to the clock pin CLK of the counter 212. The setting of the DIP switch 214 can be set either by the manufacturer or the installer to allow the predetermined duration of the delay timer 56 to be selected to meet installation requirements. The Q2 output pin of counter 210 is also connected to the tone and voice signal recognizer 46 via node P6 and provides synchronizing pulses as will be described.

The clock pin CLK of counter 210 is connected to the Q output pin of time signal generator 206 while its enable pin EN is coupled to the enable and VCC pins of counter 212. The reset pin R of counter 210 is coupled to the reset pin of counter 212 and the GND pin of counter 210 is connected to signal ground G. The enable, VCC and Q3 output pins of the counter 212 are connected to the counting unit 204.

Counting unit 204 also includes a pair of counters 220 and 222 respectively. The clock pin CLK of counter 220 is connected to the Q3 output pin of counter 212 while its enable pin EN is coupled to the enable pins of counters 210 and 212. The reset pin R of counter 220 is coupled to the reset pins of the counters 210 and 212 and the GND pin of counter 220 is connected to signal ground G. The Q1 output pin of counter 220 is connected to the clock pin CLK of counter 222. The enable pin EN of counter 222 is coupled to the enable pins of the counters 210, 212 and 220. The reset pin R of the counter 222 is also coupled to the reset pins of the counters 210, 212 and 220 as well as to terminals of a resistor 224 and a capacitor 226 in parallel. The other terminal of the capacitor 226 is connected to signal ground G while the other terminal of resistor 224 is connected to one terminal of another resistor 228, to the anode of a diode 230 and to the Q1 output pin of the counter 222. The cathode of diode 230 is connected to node P4 and the other terminal of resistor 228 is connected to signal ground G.

The Q1 output pin of counter 222 is also connected to one terminal of a resistor 240. The other terminal of resistor 240 is connected to the gate of MOSFET 150 by way of node P1 as well as to one terminal of resistor 152. The drain of MOSFET 150 is connected to one terminal of a resistor 244 as well as to the reset pin R of the start and stop unit 208 by way of node P2. The other terminal of resistor 244 is coupled to the enable pins EN of the counters 210, 212, 220 and 222 and is connected to the VCC pin of the start and stop unit 208, to the voltage node VCC and to one terminal of a resistor 250.

The THR and GND pins of the start and stop unit 208 are coupled directly to signal ground G while the CVolt pin is connected to signal ground G via a capacitor 248. The TRIG pin of the start and stop unit 208 is connected to the manual switch 54 and set coil 36 by way of node P3.

The other terminal of resistor 250 is connected to the DIS pin of time signal generator 206 and to one terminal of a resistor 252. The other terminal of resistor 252 is connected to one terminal of a capacitor 254 as well as to the THR pin of time signal generator 206. The value of capacitor 254 determines the frequency of the output pulses generated by the time signal generator 206. The THR pin of the time signal generator 206 is also coupled to its TRIG pin. The other terminal of the capacitor 254 is coupled to the CVolt pin of the time signal generator 206 by way of a capacitor 256 as well as to signal ground G. The reset pin R of time signal generator 206 is coupled to the VCC pin of the start and stop unit 208.

Figure 5:
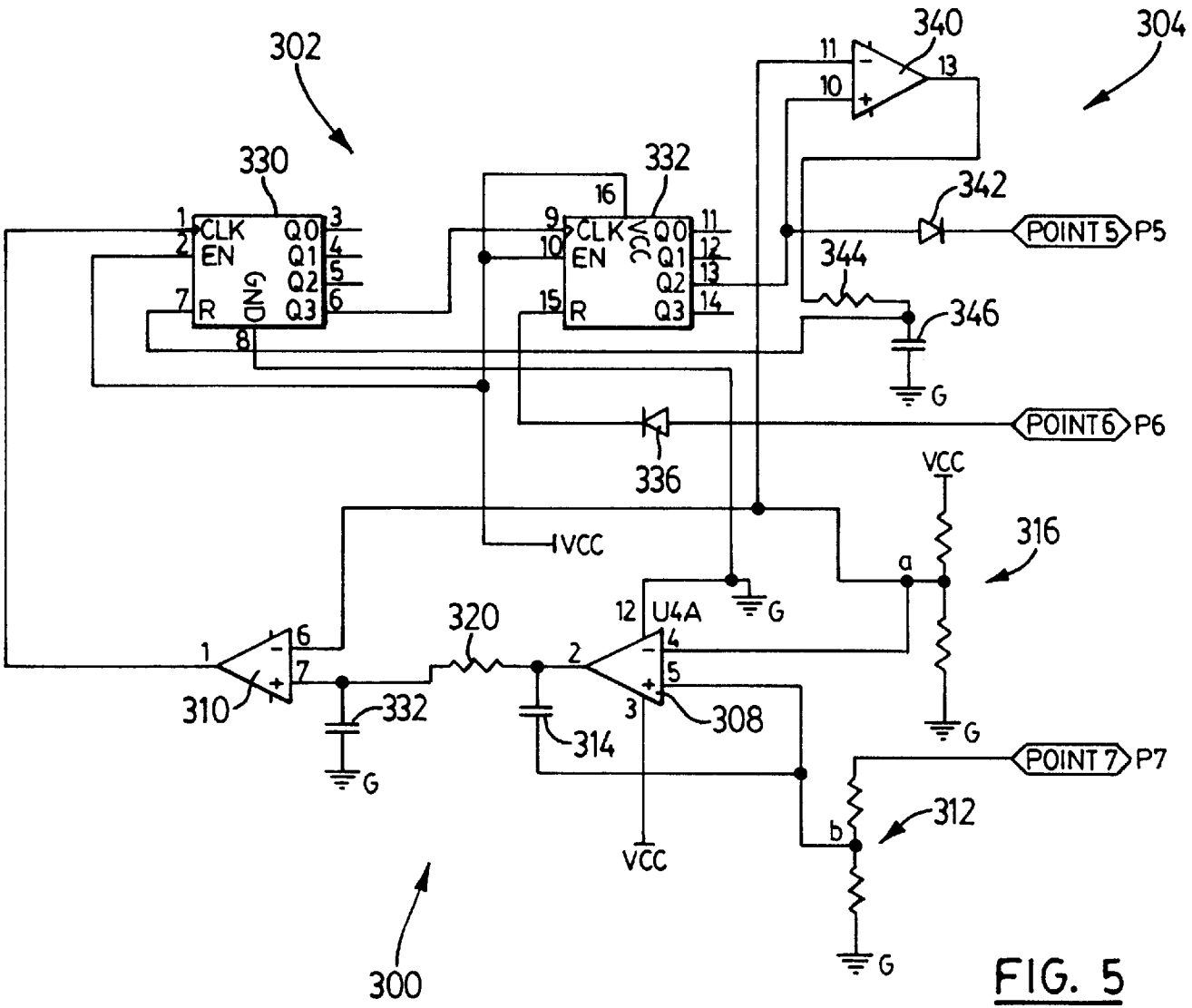
FIG. 5 is a circuit diagram of a tone and voice signal recognizer forming part of the speaker controller of FIG. 2.

Referring now to FIG. 5, the tone and voice signal recognizer 46 is better illustrated and as can be seen, it includes a signal filter 300, a counting and judgment unit 302 and a counter reset unit 304. The signal filter 300 outputs logic high pulses when the magnitude of the input signal to the speaker 14 received from the speaker loop 16 exceeds a threshold value. The counter and judgment unit 302 counts the logic high pulses and resets the latch relay 34 when the count reaches a predetermined value signifying high frequency (voice) signals being conveyed to the speaker 14 via the speaker loop 16.

The signal filter 300 includes a pair of operational amplifiers (op-amps) 308 and 310. Op-amp 308 has its non-inverting terminal connected to a voltage divider 312 connected to line 24 via node P7 and to signal ground G. The non-inverting terminal of op-amp 308 is also coupled to its output terminal by way of a capacitor 314. The inverting terminal of op-amp 308 is also connected to a voltage divider 316 coupled between voltage node VCC and signal ground G.

The output terminal of op-amp 308 is connected to the non-inverting terminal of op-amp 310 by way of a resistor 320 and to a capacitor 322 extending to signal ground G. The non-inverting terminal of op-amp 310 is coupled to the non-inverting terminal of the op-amp 308. The output terminal of the op-amp 310 is connected to the counting and judgment unit 302.

The counting and judgment unit 302 includes a pair of counters 330 and 332. Counter 330 receives the output of the op-amp 310 on its clock pin CLK. The enable pin EN of the counter 330 is coupled to the enable and VCC pins of counter 332 as well as to voltage node VCC. The Q3 output pin of the counter 330 is connected to the clock pin CLK of counter 332 while its GND pin is connected to signal ground G. The reset pins R of the counters 330 and 332 are coupled and are connected to the cathode of a diode 336 and to the counter reset unit 304. The anode of diode 336 is connected to the Q2 output pin of counter 210 by way of node P6. The Q2 output pin of the counter 332 is also connected to the counter reset unit 304.

The counter reset unit 304 includes an op-amp 340 having its non-inverting terminal connected to the Q2 output pin of counter 332 and to the anode of a diode 342. The cathode of diode 342 is connected to resistor 142 by way of node P5. The inverting terminal of the op-amp 340 is coupled to the non-inverting terminals of op-amps 308 and 310 and the output terminal of the op-amp 340 is connected to one terminal of a resistor 344. The other terminal of the resistor 344 is coupled to the reset pins R of the counters 330 and 332 as well as to signal ground G by way of a capacitor 346.

The operation of the fire alarm system 10 and specifically the speaker controller 20 will now be described. When an alarm in the fire alarm system 10 is triggered, the fire alarm control panel 12 detects the fire alarm condition and outputs fire alarm signals which are conveyed to the speakers 14 and broadcast to provide an audible indication that a fire alarm condition exists. Generally, the fire alarm signals are in the form of patterned tone signals although occasionally voice signals are conveyed to the speakers 14 to provide additional information concerning the fire alarm condition.

In most cases, the relay actuated switches 40 of the relays 34 are in closed conditions to connect the speakers 14 to the speaker loop 16 so that when a fire alarm condition occurs and fire alarm signals are generated, the fire alarm signals are broadcast. The speaker controllers 20 however, allow the speakers 14 to be disconnected from the speaker loop 16 unless one of a number of predetermined conditions occur at which time, the speaker controllers 20 automatically reconnect the speakers 14 to the speaker loop 16. The specific operation of a speaker controller 20 will now be described assuming initially that no fire alarm condition exists and that the relay actuated switch 40 of the speaker controller is in a closed condition.

When a fire alarm condition occurs and fire alarm signals are broadcast by the speaker 14, the AC fire alarm tone and/or voice signals appearing on lines 22 and 24 are used to power the speaker controller 20. Specifically, the rectifier 110 converts the AC signals into DC and uses the DC signals to charge the capacitors 118 and 126. Since the speaker controller 20 only draws AC signals from the lines 22 and 24, the current drawn is generally less than 7 mA which is insufficient to put the fire alarm control panel 12 in a "trouble state".

If the occupant wishes to disconnect the speaker 14 from the speaker loop 16 as the fire alarm signals are broadcast, the manual switch 54 is depressed. When the manual switch 54 is depressed, the set coil 36 is connected to signal ground G allowing capacitor 126 to discharge. This results in the relay actuated switch 40 assuming an open condition thereby disconnecting the speaker 14 from the speaker loop 16.

At the same time, the trigger pin TRIG of the start and stop unit 208 is also connected to signal ground G causing the start and stop unit to output a logic high on its Q output pin. The logic high on the Q output pin is applied to the reset pin R of the time signal generator 206. The logic high on the reset pin R of time signal generator 206 causes the timing signal generator 206 to output pulses on its Q output pin. The output pulses of the timing signal generator 206 are conveyed to the clock pin CLK of counter 210. As the pulses are received, the counter 210 counts the pulses and outputs digital values on its Q0 to Q3 output pins representing the counted pulses. Depending on the setting of the DIP switch 214, the logic values appearing on one of the Q0 to Q3 output pins are conveyed to the clock pin CLK of the counter 212. Counter 212 in turn counts the logic high values applied to its clock pin CLK and outputs digital values on its Q0 to Q3 output pins representing the counted logic high values. The logic high values output on the Q3 output pin of counter 212 are in turn applied to the clock pin CLK of counter 220. Counter 220 counts the logic high values applied to its clock pin CLK and outputs digital values on its Q0 to Q3 output pins representing the counted logic high values. The logic high values output on the Q1 output pin of counter 220 are in turn applied to the clock pin CLK of counter 222. Counter 222 counts the logic high values applied to its clock pin CLK and outputs digital values on its Q0 to Q3 output pins.

When the output on the Q1 output pin of counter 222 changes to a logic high signifying the expiration of the delay timer 56, the logic high is applied to the gate of MOSFET 150 causing the MOSFET 150 to close. When the transistor 150 closes, the reset pin R of the start and stop unit 208 is connected to signal ground G thereby changing its state to a logic low. This in turn causes the start and stop unit 208 to output a logic low on its Q output pin. The logic low on the Q output pin of the start and stop unit 208 is applied to the reset pin R of the time signal generator 206 causing the time signal generator to stop outputting pulses to the counter 210. The logic high output on the Q3 output pin of the counter 222 is also applied to the reset pins R of the counters 210, 212, 220 and 222 through the delay circuit constituted by resistor 224 and capacitor 226 thereby resetting the counters after a delay.

The logic high on the Q1 output pin of counter 222 is also applied to the gate of MOSFET 144 via diode 230 and resistor 142. The logic high on the gate of MOSFET 144 causes it to close thereby connecting the reset coil 38 to signal ground G allowing capacitor 36 to discharge. This results in the relay actuated switch 40 assuming a closed condition thereby reconnecting the speaker 14 to the speaker loop 16. As will be appreciated, when the manual switch 54 is depressed to disconnect the speaker 14 from the speaker loop 16, the speaker 14 is automatically reconnected to the speaker 14 loop 16 after a predetermined delay. This ensures that the speaker 14 is ready to broadcast fire alarm signals for the next occurring fire alarm condition. The setting of the DIP switch 214 and connection of the counters 220 and 222 in the present embodiment sets a time delay equal to about 9 minutes satisfying Canadian Fire Code requirements. However, by changing the DIP switch 214 setting and the connections between the counters, different delay times can be selected.

While the delay timer 56 is operating as described above, the tone and voice signal recognizer 46 monitors the signals being conveyed to the speaker 14 via the speaker loop 16 to determine if voice signals are being conveyed to the speaker 14. In particular, the op-amp 308 compares the signals received from line 24 with a reference voltage determined by voltage divider 316 and the voltage on voltage node VCC. The output of the op-amp 308 is filtered by resistor 320 and capacitor 322 prior to being applied to op-amp 310. Op-amp 310 compares the signals received from op-amp 308 with the reference voltage and generates logic high output pulses when the input from op-amp 308 is greater in magnitude than the reference voltage. The output of the op-amp 310 is applied to the clock pin CLK of counter 330. Counter 330 in turn counts the pulses received on its clock pin and outputs corresponding digital values on its Q0 to Q3 output pins. The output on the Q3 output pin of the counter 330 is applied to the clock pin CLK of the counter 332 which in turn outputs corresponding digital values on its Q0 to Q3 output pins.

While the counters 330 and 332 are operating, synchronizing pulses extracted from the Q2 output pin of counter 210 are applied to their reset pins R by way of diode 336 and node P6. When the synchronizing pulses are received, the counters 330 and 332 are reset. Since fire alarm tone signals are repetitive and their frequency is generally constant, the counters 330 and 332 are generally reset by the synchronizing pulses before a logic high output appears on the Q2 output pin of the counter 332. In this way, fire alarm tone signals do not cause the Q2 output pin of counter 332 to attain a logic high state. However, since voice signals have a much greater frequency content, when voice signals are received by op-amp 308, the counter 332 reaches a count resulting in a logic high appearing on its Q2 output pin before the counters 220 and 332 are reset by the synchronizing pulses.

When the output on the Q2 output pin of counter 332 goes high, the logic high is applied to the gate of MOSFET 144 by way of diode 342 and resistor 142. This causes the MOSFET 144 to close thereby connecting the reset coil 38 of the latch relay 34 to signal ground G allowing capacitor 116 to discharge. As a result, the relay actuated switch 40 closes thereby reconnecting the speaker 14 to the speaker loop 16. In this manner, voice signals appearing on lines 22 and 24 cause the speaker controller 20 to reconnect automatically the speaker 14 to the speaker loop 16 before the delay timer 56 times out. Also, when the output on the Q2 output pin of counter 332 goes high, the output of op-amp 340 goes low resulting in a change of state appearing on the reset pins R of the counters 330 and 332 causing the counters to reset.

In addition, if the output of the rectifier 110 drops below a predetermined value for a predetermined period of time, the signal pulse generator constituted by resistors 116, 132, 134 and 138, capacitor 136 and diode 140 supplies a logic high to the gate of MOSFET 144. This causes the MOSFET 144 to close thereby connecting the reset coil 38 of latch relay 34 to signal ground G allowing capacitor 116 to discharge. As a result, the relay actuated switch 40 closes thereby reconnecting the speaker 14 to the speaker loop 16. Thus, if a delay occurs between fire alarm signals and the delay lasts for at least two minutes signifying a new fire alarm condition, the speaker 14 is reconnected automatically to the speaker loop 16 regardless of the previous state of the latch relay 34.

As will be appreciated by those of skill in the art, the present speaker controller allows the speaker to be disconnected from the speaker loop but ensures the speaker is automatically reconnected if any one of a number of conditions occur. Therefore, fire alarm signals associated with false alarms can be muted while ensuring voice evacuation signals are broadcast. Also, since the speaker controller draws little current from the speaker loop, it can be retrofitted to existing fire alarm systems while complying with fire alarm system supervisory requirements.

Figure 6:
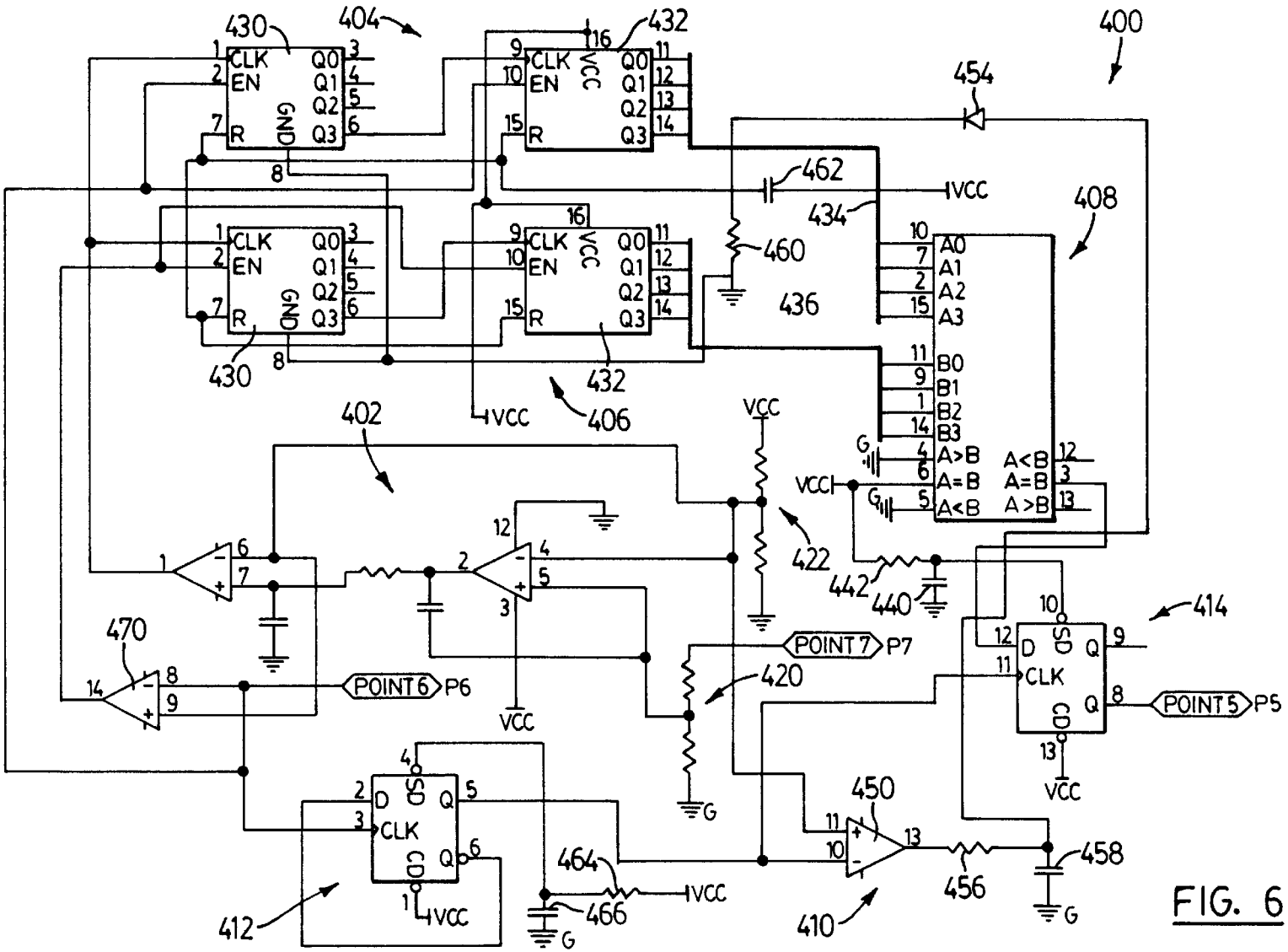
FIG. 6 is a circuit diagram of a second embodiment of a tone and voice signal recognizer for the speaker controller of FIG. 2.

Referring now to FIG. 6, an alternative embodiment of a tone and voice signal recognizer 400 is shown. The voice signal recognizer 400 includes a signal filter 402, a pair of counting units 404 and 406, a compare unit 408, a counter reset unit 410 and a pair of synchronizing units 412 and 414 respectively. The synchronizing units 412 and 414 are in the form of leading edge triggered flip-flops. The signal filter 402 is basically the same as signal filter 300 and compares input received from line 24 by way of voltage divider 420 and node P7 with the reference voltage received via voltage divider 422. The output of the signal filter 402 is applied to each of the counting units 404 and 406.

Each counting unit includes a pair of counters 430 and 432 configured in a similar manner to counters 330 and 332. The Q0 to Q3 output pins of counter 432 forming part of counting unit 404 are coupled to the A0 to A3 input pins of compare unit 408 by way of a bus 434. The Q0 to Q3 output pins of counter 432 forming part of counting unit 406 are applied to the B0 to B3 input pins of compare unit 408 by way of a bus 436. The A=B output pin of compare unit 408 is supplied to the D pin of the synchronizing unit 414. The SD pin of the synchronizing unit 414 is connected to the A=B input pin of the compare unit 408 by way of a delay circuit constituted by a capacitor 440 and a resistor 442.

The $\overline{Q}$ output pin of the synchronizing unit 414 is connected to the gate of MOSFET 144 by way of node P5 and resistor 142. The clock pin CLK of the synchronizing unit 414 is connected to the Q output pin of the synchronizing unit 412. The Q output pin of the synchronizing unit 412 is also connected to the counter reset unit 410. The counter reset unit 410 includes an op-amp 450 having its inverting terminal coupled to the Q output pin of the synchronizing unit 412 and its inverting terminal connected to the voltage divider 422. The output terminal of the op-amp 450 is applied to the anode of a diode 454 by way of a resistor 456 and a capacitor 458. The cathode of the diode 454 is connected to the reset pins R of the counters 430 and 432 via to a delay circuit constituted by a resistor 460 and a capacitor 462.

The $\overline{Q}$ output pin of the synchronizing unit 412 is coupled to its D pin while the SD pin of the synchronizing unit 412 is connected to voltage node VCC through a resistor 464 and to signal ground G through capacitor 466. The clock pin CLK of the synchronizing unit 412 is coupled to the inverting terminal of an op-amp 470. The inverting terminal of the op-amp 470 is also connected to the Q2 output pin of counter 210 via node P6. The non-inverting terminal of the op-amp 470 is coupled to the voltage divider 422. The output terminal of the op-amp 470 is coupled to the nable pins EN of the counters 430 and 432. The enable pins EN of counters 430 and 32 are also coupled to the Q2 output pin of counter 210 by way of node P6.

In operation, the signal filter unit 402 outputs logic high pulses to the counting units 404 and 406 when the output of voltage divider 420 exceeds the reference voltage determined by voltage divider 422. Each counting unit counts the logic high values and outputs digital counts to the compare unit 408 via the busses 434 and 436 respectively. Op-amp 470, which functions as an inverter, applies its output to the enable pins EN of the counters 430 and 432 of counting unit 406. The synchronizing pules from node P6 are applied to the enable pins EN of the counters 430 and 432 of counting unit 404. The counters of counting unit 404 are enabled when logic high values appear on node P6 and the counters of counting unit 406 are enabled by logic high pulses output by the op-amp 470 in response to logic lows appearing on node P6.

Synchronizing unit 412 also receives the synchronizing pulses from node P6 on its clock pin CLK. The synchronizing unit 412 which is configured as a one bit counter, changes the logic value on its Q output pin in response to each synchronizing pulse. Therefore, the Q output pin of synchronizing unit 412 goes to a logic high state on receiving every second synchronizing pulse. The logic level on the Q output pin of the synchronizing unit 412 is applied to the clock pin CLK of the synchronizing unit 414.

The compare unit 408 compares the count values received from the counters 432 via the busses 434 and 436 and compares them. If the data received from each counter 432 is the same, the compare unit 408 outputs a logic high on its A=B output pin. Otherwise, a logic low is output on the A=B output pin. The output on the A=B output pin of compare unit 408 is applied to the D pin of synchronizing unit 414. When a logic high is received on the D pin synchronizing unit 414 and a logic high is received on its clock pin CLK via the Q output pin of the synchronizing unit 412, the logic value on the Q output pin of the synchronizing unit goes to a logic high state resulting in a logic low state appearing on the $\overline{Q}$ output pin. However, if the logic level on the A=B output pin of the compare unit 408 is low, the output on the Q output pin of the synchronizing unit is also low resulting in a logic high appearing on the $\overline{Q}$ output pin of the synchronizing unit 414. The logic high on the $\overline{Q}$ output pin of synchronizing unit 414 is applied to the gate of MOSFET 144 causing it to close. When MOSFET 144 closes, the reset coil 38 is set thereby closing the relay actuated switch 40 and reconnecting the speaker 14 to the speaker loop 16.

The op-amp 450 generates counter reset pulses when the logic level on the Q output pin of synchronizing unit 412 goes low causing the counters 430 and 432 to be reset after a delay determined by resistor 456 and capacitor 458.

As will be appreciated, when patterned tone signals are received, the counts generated by the counting units 404 and 406 respectively are equal over their operating intervals due to the regularity of the tone signals. However, voice signals appearing on the lines 22 and 24 are irregular and therefore, the count values of the counting units are generally not equal over their operating intervals. In this manner, voice signals appearing on the lines 22 and 24 will result in the tone and voice signal recognizer 400 closing the relay actuated switch 40 of the latch relay 34 thereby reconnecting the speaker 14 to the speaker loop 16.

Figure 7:
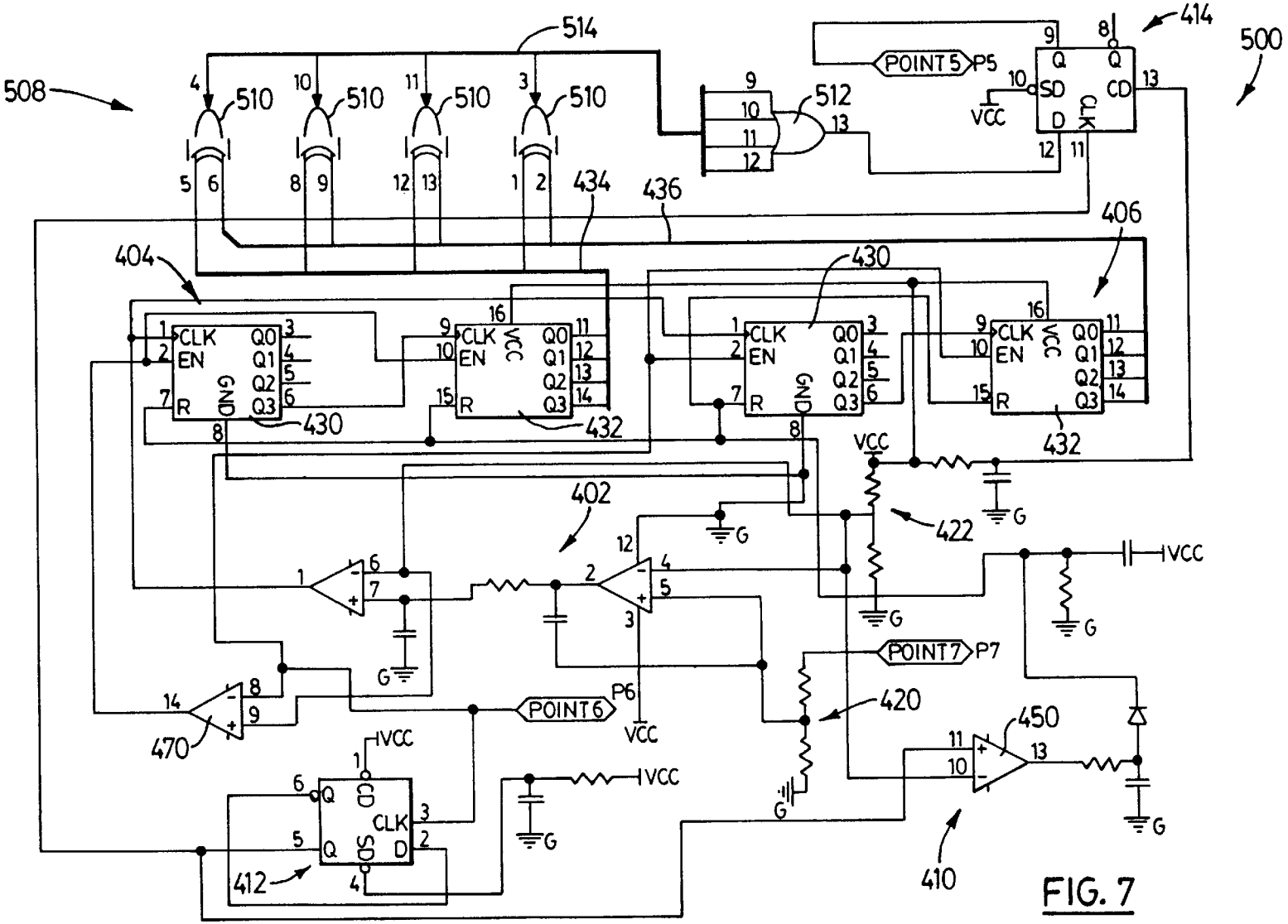
FIG. 7 is a circuit diagram of a third embodiment of a tone and voice signal recognizer for the speaker controller of FIG. 2.

Turning to FIG. 7, yet another embodiment of a tone and voice signal recognizer is shown and is generally indicated to by reference numeral 500. The tone and voice signal recognizer is similar to that of the previous embodiment except that the busses 434 and 436 are coupled to input pins of an array 508 of NAND gates 510 instead of a compare unite 408. The output pins of the NAND gates 510 are connected to the input pins of a NOR 512 gate by way of a bus 514. The output pin of the NOR gate 512 is connected to the D pin of the synchronizing unit 414.

The operation of the tone and voice signal recognizer 500 is basically the same as that of the previous embodiment. The array 508 of NAND gates 510 and the NOR gate 512 function as a compare unit supplying signals to the synchronizing unit 414 which cause the synchronizing unit 414 to output a logic high on its Q output pin when the input supplied to the array of NAND gates 510 by each counting unit is different. The Q output pin is connected to node P5 to allow the latch relay 34 to be reset in response to voice signals appearing on lines 22 and 24.

Although preferred embodiments of the present invention have been described, those of skill in the art will appreciate that variations and modifications may be made without departing from the spirit and scope thereof as defined by the appended claims.

We claim:

1. A speaker controller for use in a broadcasting system including a speaker receiving tone and/or voice signals during an alarm condition, said controller comprising:

a signal recognizer to monitor the signals conveyed to said speaker;

a switching circuit actuable to disable said speaker during said alarm condition;

a reset circuit responsive to said signal recognizer, said reset circuit resetting said switching circuit thereby to enable said speaker upon a voice signal condition being conveyed to said speaker that is detected by said signal recognizer so that voice signals are broadcast by said speaker; and a delay timer generating a reset signal after a predetermined amount of time has elapsed after said switching circuit has been actuated to disable said speaker, said reset circuit receiving said reset signal and resetting said switching circuit in response thereto thereby to enable said speaker.

2. The speaker controller as defined in claim 1 wherein said signal recognizer is in the form of a tone and signal voice signal recognition circuit, said tone and voice signal recognition circuit differentiating between tone and voice signals being conveyed to said speaker and providing output to said reset circuit upon detection of said voice signals.

3. A speaker controller as defined in claim 2 further including a pair of power reserve circuits receiving the tone and voice signals applied to said speaker, each of said power reserve circuits charging an energy store in response to said tone and voice signals.

4. The speaker controller as defined in claim 3 wherein one of said power reserve circuits powers said switching circuit, and wherein the other of said power reserve circuits powers said tone and voice signal recognition circuit and said reset circuit.

5. The speaker controller as defined in claim 4 wherein said switching circuit includes a relay actuated switch connected to an input to said speaker and actuable between open and closed conditions to disable and enable said speaker, and a pair of relay coils energizeable to actuate said relay actuated switch between said open and closed conditions.

6. The speaker controller as defined in claim 5 wherein said one power reserve circuit supplies power to said relay coils in response to both said switching circuit and said reset circuit.

7. A speaker controller as defined in claim 6 wherein said one power reserve circuit includes a pair of isolated charge stores, each of said charge stores supplying power to a respective one of said relay coils.

8. The speaker controller as defined in claim 1 wherein said reset circuit actuates said switching circuit to enable said speaker when signals conveyed to the speaker drop below a predetermined value for a predetermined amount of time.

9. A speaker controller for a fire alarm system including a control panel and at least one speaker to broadcast tone and/or voice signals during a fire alarm condition, said speaker controller acting between said control panel and said at least one speaker and comprising:

a signal recognizer to monitor tone and/or voice signals conveyed to said speaker;

a manually actuable switching circuit actuable to disable said speaker during said fire alarm condition;

a reset circuit responsive to said signal recognizer, said reset circuit resetting said switching circuit thereby to enable said speaker upon a voice signal condition being conveyed to said speaker and detected by said signal recognizer so that voice signals are broadcast by said speaker; and a delay timer generating a reset signal after a predetermined amount of time has elapsed after said switching circuit has been actuated to disable said speaker, said reset circuit receiving said reset signal and resetting said switching circuit in response thereto thereby to enable said speaker.

10. The speaker controller as defined in claim 9 wherein said reset circuit actuates said switching circuit to enable said speaker when signals conveyed to the speaker drop below a predetermined value for a predetermined amount of time.

11. A fire alarm system comprising:

a control panel;

a plurality of speakers connected to said control panel, said speakers receiving tone and/or voice signals in response to a fire alarm condition detected by said control panel and broadcasting said tone and/or voice signals to signify said fire alarm condition; and a speaker controller associated with each of said speakers, each said speaker controller being responsive to user input to disable said associated speaker during said fire alarm condition and being responsive to a voice signal condition conveyed to said associated speaker during said fire alarm condition to reset and enable said speaker thereby to broadcast voice signals.

12. The fire alarm system as defined in claim 11 wherein each said speaker controller includes a signal recognizer to monitor signals conveyed to said speaker; a manually actuable switching circuit to disable said speaker; and a reset circuit responsive to said signal recognizer, said reset circuit resetting said switching circuit thereby to enable said speaker upon said voice signal condition being conveyed to said speaker and detected by said signal recognizer.

13. The fire alarm system as defined in claim 12 wherein each speaker controller further comprises a delay timer to generate a reset signal after a predetermined amount of time has elapsed after said switching circuit has been actuated to disable said speaker, said reset circuit receiving said reset signal and resetting said switching circuit in response thereto thereby to enable said speaker.

14. The fire alarm system as defined in claim 13 wherein the reset circuit of each speaker controller actuates said switching circuit to enable said speaker when signals conveyed to the speaker drop below a predetermined value for a predetermined amount of time.

15. A speaker controller for a broadcasting system including a speaker to broadcast tone and voice signals, said speaker controller comprising:

a manually actuable switch actuable to disable said speaker during signal broadcasting;

a signal recognizer monitoring the signals conveyed to said speaker, said signal recognizer detecting a change in signals conveyed to said speaker and signalling a reset condition when said speaker is disabled; and a reset circuit responsive to said reset condition to reset said switch thereby to enable said speaker upon a change in signal condition to said speaker so that said speaker broadcasts said signals.

16. The speaker controller as defined in claim 15 further comprising a delay timer to generate a reset signal after a predetermined amount of time has elapsed after said switch has been actuated to disable said speaker, said reset circuit receiving said reset signal and resetting said switch in response thereto thereby to enable said speaker.

17. The speaker controller as defined in claim 16 wherein said reset circuit actuates said switch to enable said speaker when signals conveyed to the speaker drop below a predetermined value for a predetermined amount of time.

18. The speaker controller as defined in claim 17 wherein said signal recognizer signals said reset condition in response to a tone to voice signal change.

19. A speaker controller for a broadcasting system including a speaker to broadcast tone and/or voice signals, said speaker controller comprising:

a switching circuit actuable to disable said speaker;

a signal recognizer monitoring the signals conveyed to said speaker, said signal recognizer detecting a change in signals conveyed to said speaker and signalling a reset condition when said speaker is disabled;

a reset circuit responsive to said reset condition to reset said switching circuit thereby to enable said speaker upon a change in signal condition to said speaker so that signals are broadcast by said speaker; and a timer to generate a reset signal after a predetermined amount of time has elapsed after said switching circuit has been actuated to disable said speaker, said reset circuit receiving said reset signal and resetting said switching circuit in response thereto thereby to enable said speaker so that signals are broadcast by said speaker.

20. The speaker controller as defined in claim 19 wherein said signal recognizer signals said reset condition in response to a tone to voice signal change.

21. The speaker controller as defined in claim 20 wherein said reset circuit actuates said switching circuit to enable said speaker when signals conveyed to the speaker drop below a predetermined value for a predetermined amount of time.

22. A speaker controller for a broadcasting system including a speaker to broadcast tone and voice signals, the speaker controller comprising:

a manually actuable switch actuable to disable said speaker; and a reset circuit responsive to any one of a number of predetermined conditions to reset the switch thereby to enable said speaker so that signals are broadcast by said speaker, said predetermined conditions including:

a change in the type of signals conveyed to said speaker;

the elapsing of a predetermined amount of time following actuation of said switch; and the dropping of signal levels to the speaker below a predetermined value for a predetermined amount of time.

* * * * *